US005462682A

United States Patent [19]

Delfort et al.

[11] Patent Number: 5,462,682

[45] Date of Patent: Oct. 31, 1995

[54] COLLOIDAL PRODUCTS CONTAINING CALCIUM AND/OR MAGNESIUM, AS WELL AS SULFUR AND NITROGEN, THEIR PREPARATION AND THEIR USE PARTICULARLY AS ADDITIVES IN LUBRICATING OILS

[75] Inventors: Bruno Delfort, Paris; Bertrand Daqudal, Pontigny; Jacques Lallement, Aubervilliers; Maurice Born, Nanterre; Pierre Marchand, Orgeval; Jean-Claude Hipeaux, Colombes, all of France

[73] Assignee: Institut Francais Du Petrole, Rueil Malmaison, France

[21] Appl. No.: 292,004

[22] Filed: Aug. 18, 1994

[30] Foreign Application Priority Data

Aug. 18, 1993 [FR] France ..... 93 10128

[51] Int. Cl.[6] ..... C10M 135/36; C10M 137/00

[52] U.S. Cl. ..... 252/18; 252/32.7 R; 252/32.5; 252/33.2; 252/33.6; 252/39; 252/47.5

[58] Field of Search ..... 252/32.5, 32.7 R, 252/33.2, 33.6, 39, 47.5, 18

[56] References Cited

U.S. PATENT DOCUMENTS 5,080,812 1/1992 Parc et al. ..... 252/32.7 R
5,256,319 10/1993 Parc et al. ..... 252/32.7 R
5,324,440 6/1994 Delfort et al. ..... 252/33.2

FOREIGN PATENT DOCUMENTS 390664 10/1990 European Pat. Off. .
536020 4/1993 European Pat. Off. .

OTHER PUBLICATIONS

Chemical Abstracts 122:85168, 1994 (Month Unknown).

*Primary Examiner*—Prince Willis, Jr.
*Assistant Examiner*—Alan D. Diamond
*Attorney, Agent, or Firm*—Millen, White, Zelano & Branigan

[57] ABSTRACT

Colloidal products containing calcium and/or magnesium plus sulfur and nitrogen are obtained by at least partial neutralization of the basicity reserve of at least one overbasic sulfonate charged with calcium carbonate and/or with magnesium carbonate dispersed within micelles. The neutralization is by means of at least one functional dicarboxylic acid of the formula:

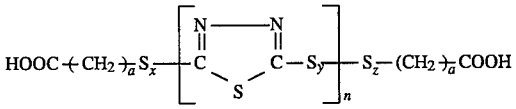

where each symbol a is a whole number from 1 to 8, x and z are each a number from 1 to 4, y is a whole number from 0 to 4 and n is 1 or 2. These products can be used as additives in lubricating oils.

17 Claims, No Drawings

COLLOIDAL PRODUCTS CONTAINING CALCIUM AND/OR MAGNESIUM, AS WELL AS SULFUR AND NITROGEN, THEIR PREPARATION AND THEIR USE PARTICULARLY AS ADDITIVES IN LUBRICATING OILS

BACKGROUND OF THE INVENTION

This invention relates to new colloidal products containing calcium and/or magnesium, as well as sulfur and nitrogen, their preparation and their use particularly as additives in lubricating oils.

Overbasic detergent additives as a class have been known for a long time. Some of them and their preparation have been described, for example, in U.S. Pat. Nos. 2,865,956, 3,150,088, 3,537,996, 3,830,739, 3,865,737, 3,953,519, 3,966,621, 4,148,740 and 4,505,830 and French Patent 2,101,813. Variants of the superbasification reaction exist which make use particularly of carbonates preformed from alkoxides and $CO_2$ before contact with the alkaline or alkaline-earth salt of the acid compound; they are described particularly in U.S. Pat. Nos. 2,965,018, 3,932,289 and 4,104,180.

It is also known to modify overbasic detergent additives by incorporating boron derivatives, as described, for example, in U.S. Pat. Nos. 3,907,691, 3,929,650, 4,965,003 and 4,965,004.

The modification of overbasic detergent additives by certain carboxylic acids, boric acids or phosphoric acids has also been described in U.S. Pat. No. 4,328,111.

Further, French Patent FR-B-2,645,168 describes compounds containing thiophosphorus obtained by reaction of a sodium sulfonate or of a calcium sulfonate superbasified by sodium carbonate or calcium carbonate, with a phosphorus sulfide, in general $P_4S_{10}$, this reaction optionally being followed by a reaction with a compound with active hydrogen, which could be water, methanol, isopropanol, a phenol, acetic acid, a dialkylphosphite, boric acid, phosphoric acid, ammonia, an amide, dimercaptothiadiazole or one of its derivatives. The compounds obtained, made soluble in a hydrocarbon medium by micellization, can be used as antiwear and extreme pressure additives in lubricating oils.

Finally, French Patent FR-B-2,681,872 describes and claims colloidal products containing boron and phosphorus, obtained by a process in which a borated overbasic alkaline or alkaline-earth sulfonate is prepared: A phosphorus sulfide is reacted with this product and the resulting product is separated. These products are also used as antiwear and extreme pressure additives in lubricating oils and greases. It is also possible to cite French Patent FR-B 2689031, which describes and claims colloidal products, themselves also usable as antiwear and extreme pressure additives in lubricating oils. They are defined as being obtained by reaction of a superbasified detergent compound (such as an alkali metal or alkaline-earth metal sulfonate, phenate, salicylate or naphthenate superbasified by an alkali metal or alkaline-earth metal carbonate or hydroxide) with a sulfur-containing carboxylic acid.

SUMMARY OF THE INVENTION

It has now been discovered, and this is one of the objects of this invention, that it was possible to prepare new colloidal products containing calcium and/or magnesium, as well as sulfur and nitrogen, by modifying colloidal products comprising a overbasic sulfonate and/or a overbasic phenate and/or a overbasic salicylate charged with calcium carbonate and/or magnesium carbonate in the form of micelles, said modification consisting of a reaction of partial neutralization of the basicity reserve (represented by the TBN or total base number of the product) of the micelles by means of at least one dicarboxylic acid of the formula:

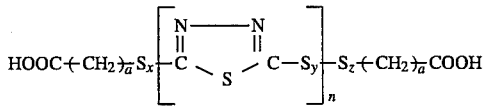

(I)

in which symbols a each represent, independently from one another, a whole number from 1 to 8, x and z each separately represent a number from 1 to 4, y represents a whole number from 0 to 4 and n has the value 1 or 2: preferably, when n has the value 1, y is 0; and when n has the value 2, y is preferably 1 or more.

More preferably still, in formula (I), each number a is 1 or 2, x and z are each 1 or 2 and y is zero or 1.

The partial neutralization of the basicity reserve of the initial overbased sulfonate and/or overbased phenate and/or overbased salicylate charged with calcium carbonate and/or magnesium carbonate can involve, for example, from 1 to 30% as expressed as basic equivalents of said basicity reserve.

The neutralization can be total if, in addition, a sulfonic acid (e.g., an alkylaryl sulfonic acid) is involved in the reaction in a sufficient proportion to neutralize the remaining basic equivalents. In the partial or total neutralization reaction of the initial overbased product, for a part (up to, e.g., 90%, expressed as acid equivalents) of the dicarboxylic acid of formula (1), some other acids can be substituted as will be described further.

The overbasic sulfonates and/or phenates and/or salycilates used as base products for the preparation of the colloidal products of the invention have an alkaline reserve in the form of calcium carbonate or of magnesium carbonate corresponding to a TBN (or total base number), which can go up to about 600 mg of KOH/g of product.

The initial overbased products are known to the art. As overbased sulfonates, can be cited, for example, some products of the trade, like those sold by WITCO Chemicals under the references, Hybase C500-C or C400-C. The TBN determination is described in ASTM Standard D 664.

The dicarboxylic acids used for the preparation of the colloidal products of the invention can be obtained particularly by reaction of a compound with a dimercaptothiadiazole group of general formula:

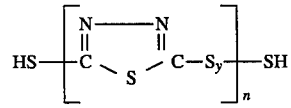

(II)

with at least one substituted monocarboxylic acid of formula (III):

$$X—(CH_2)_a—COOH \quad \text{(III)}$$

optionally in the presence of elemental sulfur. In formulas (II) and (III), y, n and a each have the same meaning as in formula (I) and X represents a halogen atom, for example, chlorine, bromine, iodine or fluorine or a nitro group.

When elemental sulfur is used, the proportion is preferably x+z−2 gram-atom per mol of compound of formula (II), x and z being defined as in formula (I). It is noted that if x and z are each equal to 1, the amount of elemental sulfur used is zero.

The reaction described above can be performed in basic medium, for example, in the presence of an alkaline metal hydroxide (particularly sodium hydroxide or potash), or ammonium hydroxide. At the end of the reaction, a neutralization in strong acid medium, such as, for example, hydrochloric acid, sulfuric acid or phosphoric acid, will generally be performed.

Another method for production of the dicarboxylic acids of formula (I), particularly those in which each a takes a value from 2 to 8, involves reacting a compound of formula (II) with an unsaturated monocarboxylic acid of formula (IV) $H_2C{=}CH{-}(CH_2)_c{-}COOH$ in which c has a whole number value from 0 to 6. The dicarboxylic acid obtained has the following formula:

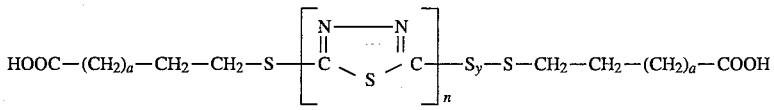

(V)

which corresponds to formula (I) in which a is c+2 and x and z would each be equal to 1.

As examples of dicarboxylic acids of formula (I) that can be used in the preparation of the colloidal products of the invention, it is possible to cite:

3,3'-(1,3,4-thiadiazole-2,5-diyl)bis(3-thiapropanoic) acid;
4,4'-(1,3,4-thiadiazole-2,5-diyl)bis(4-thiabutanoic) acid;
4,4'-(1,3,4-thiadiazole-2,5-diyl)bis(3,4-dithiabutanoic) acid;
5,5'-(1,3,4-thiadiazole-2,5-diyl)bis(4,5-dithiapentanoic) acid;
bis(3-(5-thio-1,3,4-thiadiazol-2-yl)-3-thiapropanoic) acid;
and bis(4-(5-thio-1,3,4-thiadiazol-2-yl)-4-thiabutanoic) acid.

Some acids meeting formula (I) have already been described previously. Thus, for example, document DE-A-19 21 740 describes a method of synthesis of the compounds of formula:

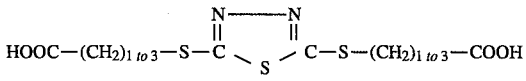

Documents EP-A-146 087 and U.S. Pat. No. 4,371,610 describe the use of such compounds in photographic procedures.

The modification of the overbasic sulfonates by the dicarboxylic acids defined above involves an at least partial neutralization of their basicity reserve (TBN).

The preparation of the colloidal products according to the invention is generally performed in an organic solvent which can be an aliphatic hydrocarbon (such as, for example, a hexane, a heptane, an octane or a nonane), a cycloaliphatic hydrocarbon (such as, for example, cyclohexane), an aromatic hydrocarbon (such as, for example, toluene or a xylene), optionally combined with tetrahydrofuran or methanol, used as co-solvents.

As indicated before, it is possible to perform jointly a modification of the overbasic sulfonate by reaction with other acids or various reagents which can be used before or after the sulfur-containing and nitrogen-containing dicarboxylic acid or at the same time as the latter.

The additional acids and reagents can be, for example, the metaboric or orthoboric acids, carboxylic acids containing sulfur such as those described in French Patent FR-B-2,689,031 already cited above, or the phosphoric acids and the alkyl, aryl or alkylaryl, phosphoric acids.

The colloidal products obtained are stable, soluble in mineral and synthetic lubricants and are characterized by their content of nitrogen, of sulfur and optionally of boron and by their content of calcium and/or of magnesium.

Their content of sulfur in the active material, i.e., the colloidal product when incorporated in a lubricant, can go up to about 30% by weight, and the content of nitrogen up to about 15% by weight, based on the colloidal product (without the dilution oil).

Their content of calcium in the active material can go, for example, up to about 30% by weight and the content of magnesium up to about 20% by weight, based on the colloidal product (without the dilution oil).

The colloidal nature of the products of the invention is verified by dialysis through a latex membrane. The analyses of nitrogen and of sulfur locate these elements in the fraction not having dialyzed (concentrate) which constitutes the colloidal part of the additive.

The colloidal compounds containing sulfur and nitrogen according to the invention constitute excellent antiwear and extreme pressure additives. The antiwear and extreme pressure additives are incorporated in the lubricants when the latter are intended to lubricate elements subjected to significant mechanical stresses, such as the distribution in thermal engines, gears, roller bearings or stops. Significant mechanical stresses also appear during the machining of metals, whether cutting or shaping is involved.

Further, the colloidal compounds containing sulfur and nitrogen according to the invention are provided with a great thermal stability, which allows their use in lubricants subjected to service at very elevated temperatures, e.g., 160° C., as in some harsh engine housings, in very charged transmissions or the cutting of metals at high speed.

The products of the invention are incorporated as additives for lubricating oils and greases at an active ingredient concentration of preferably about 0.1 to 25% by weight, more preferably 1 to 15% by weight.

The lubricating oils (or the greases) further generally contain one or more other additives, such as additives improving the viscosity index, additives for lowering the pour point, antioxidants, rustproof additives, copper anticorrosion additives, detergent additives, antiwear additives, antifoam breaker additives, dispersants, friction reducing additives, with which the products of the invention are compatible.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

In the foregoing and in the following examples, all temperatures are set forth uncorrected in degrees Celsius and unless otherwise indicated, all parts and percentages are by weight.

The entire disclosures of all applications, patents and publications, cited above and below, and of corresponding application(s) French No. 93/10128, filed Aug. 18, 1993, are hereby incorporated by reference.

In examples A to F, the synthesis of various acids that can be used in the preparation of the products according to the invention described in examples 1 to 11 are described. Examples 12 and 13 describe tests performed on some of these products.

In Examples 1 to 11, the percentages of Ca or Mg, S and N are determined on the colloidal product overall, i.e., diluted in the 130 neutral mineral oil.

EXAMPLES

EXAMPLE A

Synthesis of 3,3'-(1,3,4-thiadiazole-2,5-diyl)bis(3-thiapropanoic) acid.

A solution of 18.9 g (0.2 mol) of chloroacetic acid, 8.0 g (0.2 mol) of sodium hydroxide in 100 $cm^3$ of water, is added to a solution of 15.0 g (0.1 mol) of dimercapto-2,2'-thiadiazole and 8.0 g (0.2 mol) of sodium hydroxide in 100 $cm^3$ of water at ambient temperature in 2 hours. After an additional hour at ambient temperature, the medium is brought to 90° C. for 2 hours, then, after returning to the ambient temperature, concentrated hydrochloric acid is introduced with stirring until a persistent acid pH appears. The filtration of the obtained precipitate is then performed. After washing with water and drying, 21.5 g (92%) of product is isolated.

The product exhibits the following characteristics (% by weight):

| | |
|---|---|
| C = 27.4% | (theory = 27.8%) |
| H = 2.3% | (2.3%) |
| N = 9.9% | (10.5%) |
| S = 36.0% | (36.1%) |

EXAMPLE B

Synthesis of 4,4'-(1,3,4-thiadiazole-2,5-diyl)bis(4-thiabutanoic) acid

A solution of 32.5 g (0.3 mol) of chloropropionic acid, 12.0 g (0.3 mol) of sodium hydroxide in 100 $cm^3$ of water is added to a solution of 15.0 g (0.1 mol) of dimercapto-2,2'-thiadiazole and 8.0 g (0.2 mol) of sodium hydroxide in 100 $cm^3$ of water at ambient temperature in 2 hours. After an additional hour at ambient temperature, the medium is brought to 90° C. for 2 hours, then after returning to the ambient temperature, concentrated hydrochloric acid is introduced with stirring until a persistent acid pH appears. The filtration of the precipitate obtained is then performed. After washing with water and drying, 28.8 g (98%) of product is isolated.

The product exhibits the following characteristics (% by weight):

| | |
|---|---|
| C = 33.1% | (theory = 32.6%) |
| H = 3.5% | (3.4%) |
| N = 9.2% | (9.5%) |
| S = 30.8% | (32.6%) |

EXAMPLE C

Synthesis of 4,4'-(1,3,4-thiadiazole-2,5-diyl)bis(4-thiabutanoic) acid

A solution of 21.6 g (0.3 mol) of acrylic acid, 12.0 g (0.3 mol) of sodium hydroxide and 25 mg of paramethoxyphenol in 250 $cm^3$ of water is added to a solution of 15.0 g (0.1 mol) of dimercapto-2,2'-dithiadiazole in 250 $cm^3$ of water and 50 $cm^3$ of ethanol at ambient temperature in 30 minutes. The medium is then refluxed for 3 hours, then, after returning to the ambient temperature, concentrated hydrochloric acid is added until an acid pH appears. The filtration and washing with water of the white precipitate obtained is performed. After drying, 25.5 g (87%) of product is collected.

The product exhibits the following characteristics (% by weight):

| | |
|---|---|
| C = 33.0% | (theory = 32.6%) |
| H = 3.2% | (3.4%) |
| N = 9.2% | (9.5%) |
| S = 32.1% | (32.6%) |

EXAMPLE D

Synthesis of bis[3-(5-thio-1,3,4-thiadiazol-2-yl)-3-thiapropanoic] acid

A solution of 28.9 g (0.3 mol) of chloroacetic acid, 12.0 g (0.3 mol) of sodium hydroxide in 100 $cm^3$ of water is added to a dispersion of 29.8 g (0.1 mol) of dimercapto-2,2'-dithiadiazole in 100 $cm^3$ of water and 100 $cm^3$ of methanol in the presence of 8.0 g (0.2 mol) of sodium hydroxide at ambient temperature in 2 hours. After an additional hour at ambient temperature, the medium is refluxed for 2 hours, then, after returning to the ambient temperature, concentrated hydrochloric acid is introduced with stirring until a persistent acid pH appears. After the methanol is evaporated, the filtration of the precipitate obtained is performed. After washing with water and drying, 32.6 g (79%) of product is isolated.

The product exhibits the following characteristics (% by weight):

| | |
|---|---|
| C = 24.1% | (theory = 23.2%) |
| H = 1.5% | (1.45%) |
| N = 13.0% | (13.5%) |
| S = 44.0% | (46.4%) |

EXAMPLE E

Synthesis of bis[4-(5-thio-1,3,4-thiadiazol-2-yl)-4-thiabutanoic] acid

A solution of 32.5 g (0.3 mol) of chloropropionic acid, 12.0 g (0.3 mol) of sodium hydroxide in 100 $cm^3$ of water is added to a dispersion of 29.8 g (0.1 mol) of dimercapto-2,2'-dithiadiazole in 100 $cm^3$ of water and 100 $cm^3$ of methanol in the presence of 8.0 g (0.2 mol) of sodium hydroxide at ambient temperature in 2 hours. After an additional hour at ambient temperature, the medium is refluxed for 2 hours, then, after returning to the ambient temperature, concentrated hydrochloric acid is introduced with stirring until a persistent acid pH appears. After the methanol is evaporated, the filtration of the precipitate obtained is performed. After washing with water and drying, a product exhibiting the following characteristics is isolated (% by weight):

| | |
|---|---|
| C = 28.2% | (theory = 27.2%) |
| H = 2.2% | (2.3%) |
| N = 13.0% | (12.7%) |

-continued

| | |
|---|---|
| S = 44.5% | (43.5%) |

EXAMPLE F

Synthesis of 5,5'-(1,3,4-thiadiazole-2,5-diyl)bis(4,5-dithiapentanoic) acid

A solution of 6.4 g (0.2 mol) of sulfur in 40 $cm^3$ of ethanolamine, then at ambient temperature in 2 hours, 32.5 g (0.3 mol) of chloropropionic acid, 12.0 g (0.3 mol) of sodium hydroxide in 100 $cm^3$ of water, is added to a solution of 15.0 g (0.1 mol) of dimercapto-2,2'-thiadiazole and 8.0 g (0.2 mol) of sodium hydroxide in 100 $cm^3$ of water. After an additional hour at ambient temperature, the medium is brought to 90° C. for 2 hours, then, after returning to the ambient temperature, concentrated hydrochloric acid is introduced with stirring until a persistent acid pH appears. The extraction from the medium by two times 150 $cm^3$ of ethyl ether is then performed. After washing with water and drying of the ethereal phase, 28.8 g (98%) of product is isolated.

The product exhibits the following characteristics (% by weight):

| | |
|---|---|
| C = 27.1% | (theory = 26.8%) |
| H = 2.9% | (2.8%) |
| N = 7.9% | (7.8%) |
| S = 44.0% | (44.7%) |

EXAMPLE 1

In a reactor equipped with a stirring mechanism, a condenser, a Dean & Stark separator and an addition funnel, 50 g of a overbasic calcium sulfonate of alkaline reserve (TBN) equivalent to 500 milliequivalents of potash per gram of product and containing 18.70% of calcium, i.e., 0.4456 basic equivalent, 15 g of a 130 neutral mineral oil and 300 $cm^3$ of xylene are introduced. The medium is brought to 90° C., then a solution of 5.93 g (0.0223 mol or 0.0446 acid equivalent) of 3,3'-(1,3,4-thiadiazole-2,5-diyl)bis(3-thiapropanoic) acid in 70 $cm^3$ of tetrahydrofuran is introduced in 1 hour with the help of the funnel. The medium is kept at this temperature for an additional hour, then the tetrahydrofuran and the reaction water are distilled. After filtration, the evaporation of xylene is performed under reduced pressure. A liquid and clear product is collected whose composition by weight is the following:

Ca=13.1% S=4.9% N=0.8%

EXAMPLE 2

In a reactor equipped with a stirring mechanism, a condenser, a Dean & Stark separator and an addition funnel, 50 g of a overbasic calcium sulfonate of alkaline reserve (TBN) equivalent to 500 milliequivalents of potash per gram of product and containing 18.70% of calcium, i.e., 0.4456 basic equivalent, 20 g of a 130 neutral mineral oil and 300 $cm^3$ of xylene are introduced. The medium is brought to 90° C., then a solution of 6.55 g (0.0223 mol or 0.0446 acid equivalent) of 4,4'-(1,3,4-thiadiazole-2,5-diyl)bis(3-thiabutanoic) acid in 70 $cm^3$ of tetrahydrofuran is introduced in 1 hour with the help of the funnel. The medium is kept at this temperature for an additional hour, then the tetrahydrofuran and the reaction water are distilled. After filtration, the evaporation of the xylene is performed under reduced pressure. A liquid and clear product is collected whose composition by weight is the following:

Ca=12.8% S=5.5% N=0.8%

EXAMPLE 3

In a reactor equipped with a stirring mechanism, a condenser, a Dean & Stark separator and an addition funnel, 50 g of a overbasic calcium sulfonate of alkaline reserve (TBN) equivalent to 500 milliequivalents of potash per gram of product and containing 18.70% of calcium or 0.4456 basic equivalent, 50 g of a 130 neutral mineral oil and 300 $cm^3$ of xylene are introduced. The medium is brought to 90° C., then a solution of 6.45 g (0.0223 mol or 0.0446 acid equivalent) of bis[3-(5-thio-1,3,4-thiadiazol-2-yl)-3-thiapropanoic] acid in 70 $cm^3$ of tetrahydrofuran is introduced in 1 hour with the help of the funnel. The medium is kept at this temperature for an additional hour, then the tetrahydrofuran and the reaction water are distilled. After filtration, the evaporation of the xylene is performed under reduced pressure. A liquid and clear product is collected whose composition by weight is the following:

Ca=8.5% S=5.1% N=1.1%

EXAMPLE 4

In a reactor equipped with a stirring mechanism, a condenser, a Dean & Stark separator and an addition funnel, 50 g of a overbasic calcium sulfonate of alkaline reserve (TBN) equivalent to 500 milliequivalents of potash per gram of product and containing 18.70% of calcium, i.e., 0.4456 basic equivalent, 50 g of a 130 neutral mineral oil and 300 $cm^3$ of xylene are introduced. The medium is brought to 90° C., then a solution of 4.92 g (0.0113 mol or 0.0226 acid equivalent) of bis[4-(5-thio-1,3,4-thiadiazol-2-yl)-4-thiabutanoic] acid in 70 $cm^3$ of tetrahydrofuran is introduced in 1 hour with the help of the funnel. The medium is kept at this temperature for an additional hour, then the tetrahydrofuran and the reaction water are distilled. After filtration, the evaporation of the xylene is performed under reduced pressure. A liquid and clear product is collected whose composition by weight is the following:

Ca=8.6% S=3.1% N=0.7%

EXAMPLE 5

In a reactor equipped with a stirring mechanism, a condenser, a Dean & Stark separator and an addition funnel, 50 g of a overbasic calcium sulfonate of alkaline reserve (TBN) equivalent to 400 milliequivalents of potash per gram of product and containing 9.4% of magnesium, i.e., 0.356 basic equivalent, 40 g of a 130 neutral mineral oil and 300 $cm^3$ of xylene are introduced. The medium is brought to 90° C., then a solution of 6.3 g (0.0237 mol or 0.0474 acid equivalent) of 3,3'-(1,3,4-thiadiazole-2,5-diyl)bis(3-thiapropanoic) acid in 70 $cm^3$ of tetrahydrofuran is introduced in 1 hour with the help of the funnel. The medium is kept at this temperature for an additional hour, then the tetrahydrofuran and the reaction water are distilled. After filtration, the evaporation of the xylene is performed under reduced pressure. A liquid and clear product is collected whose composition by weight is the following:

Mg=4.4% S=3.4% N=0.7%

EXAMPLE 6

In a reactor equipped with a stirring mechanism, a condenser, a Dean & Stark separator and a addition funnel, 50 g of a overbasic calcium sulfonate of alkaline reserve (TBN) equivalent to 500 milliequivalents of potash per gram of product and containing 18.70% of calcium, i.e., 0.4456 basic equivalent, 15 g of a 130 neutral mineral oil and 300 $cm^3$ of xylene are introduced. The medium is brought to 130° C., then a solution of 10.8 g of an alkylarylsulfonic acid of molar mass equivalent to 700 (or 0.0154 acid equivalent) in 100 $cm^3$ of xylene is introduced in 30 minutes at this temperature. After azeotropic distillation of the formed reaction water, the medium is cooled to 90° C., then a solution of 11.85 g (0.0446 mol or 0.0891 acid equivalent) of 3,3'-(1,3,4-thiadiazole-2,5-diyl)bis(3-thiapropanoic) acid in 70 $cm^3$ of tetrahydrofuran is introduced in 1 hour with the help of the funnel. The medium is kept at this temperature for an additional hour, then the tetrahydrofuran and the reaction water are distilled. After filtration, the evaporation of the xylene is performed under reduced pressure. A liquid and clear product is collected whose composition by weight is the following:

Ca=8.5% S=5.1% N=1.1%

EXAMPLE 7

In a reactor equipped with a stirring mechanism, a condenser, a Dean & Stark separator and an addition funnel, 50 g of a overbasic calcium sulfonate of alkaline reserve (TBN) equivalent to 500 milliequivalents of potash per gram of product and containing 18.70% of calcium, i.e., 0.4456 basic equivalent, 50 g of a 130 neutral mineral oil and 300 $cm^3$ of xylene are introduced. The medium is brought to 130° C., then a solution of 10.8 g of an alkylarylsulfonic acid of molar mass equivalent to 700 (or 0.0154 acid equivalent) in 100 $cm^3$ of xylene is introduced in 30 minutes at this temperature. After azeotropic distillation of the formed reaction water, the medium is cooled to 90° C., then a solution of 13.1 g (0.0446 mol or 0.0891 acid equivalent) of 4,4'-(1,3,4-thiadiazole-2,5-diyl)bis(3-thiabutanoic) acid in 70 $cm^3$ of tetrahydrofuran is introduced in 1 hour with the help of the funnel. The medium is kept at this temperature for an additional hour, then the tetrahydrofuran and the reaction water are distilled. After filtration, the evaporation of the xylene is performed under reduced pressure. A liquid and clear product is collected whose composition by weight is the following:

Ca=7.6% S=4.9% N=1.1%

EXAMPLE 8

In a reactor equipped with a stirring mechanism, a condenser, a Dean & Stark separator and an addition funnel, 50 g of a overbasic calcium sulfonate of alkaline reserve (TBN) equivalent to 500 milliequivalents of potash per gram of product and containing 18.70% of calcium, i.e., 0.4456 basic equivalent, 50 g of a 130 neutral mineral oil and 300 $cm^3$ of xylene are introduced. The medium is brought to 130° C., then a solution of 10.8 g of an alkylarylsulfonic acid of molar mass equivalent to 700 (or 0.0154 acid equivalent) in 100 $cm^3$ of xylene is introduced in 30 minutes at this temperature. After azeotropic distillation of the formed reaction water, the medium is cooled to 90° C., then a solution of 14.7 g (0.0322 mol or 0.0664 acid equivalent) of bis[4-(5-thio-1,3,4-thiadiazol-2-yl)-4-thiabutanoic] acid in 70 $cm^3$ of tetrahydrofuran is introduced in 1 hour with the help of the funnel. The medium is kept at this temperature for an additional hour, then the tetrahydrofuran and the reaction water are distilled. After filtration, the evaporation of the xylene is performed under reduced pressure. A liquid and clear product is collected whose composition by weight is the following:

Ca=7.2% S=4.1% N=1.0%

EXAMPLE 9

In a reactor equipped with a stirring mechanism, a condenser, a Dean & Stark separator and an addition funnel, 50 g of a overbasic calcium sulfonate of alkaline reserve (TBN) equivalent to 500 milliequivalents of potash per gram of product and containing 18.70% of calcium, i.e., 0.4456 basic equivalent, 80 g of a 130 neutral mineral oil and 300 $cm^3$ of xylene are introduced. The medium is brought to 130° C., then a solution of 63.4 g of an alkylarylsulfonic acid of molar mass equivalent to 700 (or 0.09 acid equivalent) in 100 $cm^3$ of xylene is introduced in 30 minutes at this temperature. After azeotropic distillation of the formed reaction water, the medium is cooled to 90° C., then a solution of 47.2 g (0.177 mol or 0.354 acid equivalent) of 3,3'-(1,3,4-thiadiazole-2,5-diyl)bis(3-thiapropanoic) acid in 70 $cm^3$ of tetrahydrofuran is introduced in 1 hour with the help of the funnel. The medium is kept at this temperature for an additional hour, then the tetrahydrofuran and the reaction water are distilled. After filtration, the evaporation of the xylene is performed under reduced pressure. A liquid and clear product is collected whose composition by weight is the following:

Ca=3.7% S=8.7% N=2.3%

The examination of this product by infrared spectroscopy confirms the total consumption of the initial alkaline reserve consisting of calcium carbonate (absence of signal at 862 $cm^{-1}$).

EXAMPLE 10

In a reactor equipped with a stirring mechanism, a condenser, a Dean & Stark separator and an addition funnel, 50 g of a overbasic calcium sulfonate of alkaline reserve (TBN) equivalent to 500 milliequivalents of potash per gram of product and containing 18.70% of calcium, i.e., 0.4456 basic equivalent, 50 g of a 130 neutral mineral oil and 300 $cm^3$ of xylene are introduced. 4.11 g of orthoboric acid (0.066 mol) dispersed in 30 $cm^3$ of methanol is introduced, then the medium is refluxed for 1 hour. After azeotropic distillation of the methanol and the formed reaction water, the medium is cooled to 90° C., then a solution of 4.74 g (0.178 mol or 0.356 acid equivalent) of 3,3'-(1,3,4-thiadiazole-2,5-diyl-)bis(3-thiapropanoic) acid in 70 $cm^3$ of tetrahydrofuran is introduced in 1 hour with the help of the funnel. The medium is kept at this temperature for an additional hour, then the tetrahydrofuran and the reaction water are distilled. After filtration, the evaporation of the xylene is performed under reduced pressure. A liquid and clear product is collected whose composition by weight is the following:

Ca=7.8% S=2.6% N=0.6% B=0.5%

EXAMPLE 11

In a reactor equipped with a stirring mechanism, a condenser, a Dean & Stark separator and an addition funnel, 50 g of a overbasic calcium sulfonate of alkaline reserve (TBN) equivalent to 500 milliequivalents of potash per gram of product and containing 18.70% of calcium, i.e., 0.4456 basic equivalent, 50 g of a 130 neutral mineral oil and 300 $cm^3$ of xylene are introduced. The medium is brought to 90° C., then a solution of 5.98 g (0.0167 mol or 0.0334 acid equivalent) of 5,5'-(1,3,4-thiadiazole-2,5-diyl)bis(4,5-dithiapentanoic) acid in 70 $cm^3$ of tetrahydrofuran is introduced in 1 hour with the help of the funnel. The medium is kept at this temperature for an additional hour, then the tetrahydrofuran and the reaction water are distilled. After filtration, the evaporation of the xylene is performed under reduced pressure. A liquid and clear product is collected whose composition by weight is the following:

Ca=8.0% S=3.5% N=0.6%

EXAMPLE 12

Examination of the products by dialysis in heptane through a latex membrane

The products of preceding examples 1 to 7 and 10 are subjected to a dialysis in solution in normal heptane through a latex membrane. For each test, the mass fraction having dialyzed (dialysate) and that not having dialyzed (concentrate) are determined, the latter constituting the colloidal part. The concentration of sulfur and/or nitrogen is also determined for each fraction. The results are gathered in Table No. 1. The location of the nitrogen and the sulfur exclusively in the concentrates confirms the colloidal nature of the calcium or magnesium carboxylates of the various acids being produced.

EXAMPLE 13

Evaluation of the antiwear and extreme pressure properties

The products of preceding examples 1 to 7, 10 and 11 are evaluated for their antiwear and extreme pressure properties in a 130 neutral mineral lubricating oil. The performances are evaluated on a 4-ball machine according to the ASTM D 2783 method. The results are gathered in Table No. 2. By way of comparison, the results obtained with the same concentration in oil with a nonmodified equivalent overbasic calcium sulfonate according to the process described in the invention have been provided. The results confirm the increased performance of the products of the invention; the load/wear indices and the welding loads are very clearly improved whereas the scar diameter after one hour under the load of 40 daN is in any case less than 0.50 mm.

TABLE 1

| Product of the Example | Examination of the Products by Dialysis | | | | | | | | |
|---|---|---|---|---|---|---|---|---|---|
| | Raw Product (% by weight) | | | Concentrate | | | Dialysate | | |
| No. | Ca % | S % | N % | % | S % | N % | % | S %* | N % |
| 1 | 13.1 | 4.9 | 0.8 | 51 | 9.1 | 1.5 | 49 | 0.4 | 0 |
| 2 | 12.8 | 5.5 | 0.7 | 48 | 10.7 | 1.5 | 52 | 0.5 | 0 |
| 3 | 8.5 | 5.1 | 1.1 | 35.9 | 10.1 | 2.7 | 64.1 | 0.5 | 0 |
| 4 | 8.6 | 3.1 | 0.7 | 32.7 | 8.6 | 1.9 | 67.3 | 0.5 | 0 |
| 5 | 4.4 (Mg) | 3.4 | 0.7 | 31.7 | 10.1 | 2.0 | 68.3 | 0.5 | 0 |
| 6 | 8.3 | 5.1 | 1.1 | 42.2 | 10.9 | 2.1 | 57.8 | 0.5 | 0 |
| 7 | 7.6 | 4.9 | 1.1 | 41 | 9.9 | 2.4 | 59 | 0.4 | 0 |
| 10 | 7.8 | 2.6 | 0.6 | 34.8 | 7.1 | 1.7 | 65.2 | 0.5 | 0 |

*Concentration of sulfur of the 130 neutral oil used = 0.45% by weight.

TABLE 2

| Evaluation of the Antiwear and Extreme Pressure Properties | | | | | | |
|---|---|---|---|---|---|---|
| Product | Composition in the oil (% by weight) | | | Load/ Wear | Welding | Scar Diameter under 40 |
| of Example No. | % active material | % Ca | % S | Index (daN) | Load (daN) | daN (mm) |
| 1 | 7.1 | 1.8 | 0.7 | 71 | 450 | 0.37 |
| 2 | 7.2 | 1.9 | 0.7 | 68 | 490 | 0.39 |
| 3 | 6.5 | 1.5 | 0.9 | 65 | 390 | 0.36 |
| 4 | 6.8 | 1.8 | 0.6 | 68 | 410 | 0.44 |
| 5 | 6.6 | 0.9(Mg) | 0.7 | 51 | 300 | 0.41 |
| 6 | 9.3 | 1.8 | 1.1 | 61 | 390 | 0.41 |
| 7 | 9.9 | 1.8 | 1.2 | 51 | 390 | 0.44 |
| 10 | 7.3 | 1.6 | 0.5 | 60 | 320 | 0.37 |
| 11 | 6.9 | 1.6 | 0.7 | 66 | 370 | 0.48 |
| Reference | 6.4 | 1.9 | | 42 | 260 | 0.34 |

What is claimed is:

1. A colloidal product containing sulfur, nitrogen and at least one of calcium or magnesium, obtained by at least partial neutralization of the basicity reserve of at least one of an overbasic sulfonate, phenate or salicylate having at least one of calcium or magnesium carbonate dispersed within micelles therein, said neutralization being by at least one dicarboxylic acid of formula I:

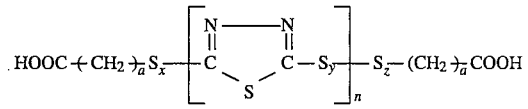

(I)

wherein a is each independently, a whole number from 1 to 8, x and z are each independently a number from 1 to 4, y is a whole number from 0 to 4 and n is 1 or 2.

2. A colloidal product according to claim 1, wherein in formula (I), each a is independently 1 or 2, x and z are each independently 1 or 2, and y is zero or 1.

3. A colloidal product according to claim 1, wherein in formula I, if n is 1, y is 0, and if n is 2, y is 1 to 4.

4. A colloidal product according to claim 1, wherein the dicarboxylic acid of formula I is:

3,3'-(1,3,4-thiadiazole-2,5-diyl)bis(3-thiapropanoic) acid;
4,4'-(1,3,4-thiadiazole-2,5-diyl)bis(4-thiabutanoic) acid;
4,4'-(1,3,4-thiadiazole-2,5-diyl)bis(3,4-dithiabutanoic) acid;
5,5'-(1,3,4-thiadiazole-2,5-diyl)bis(4,5-dithiapentanoic) acid;
bis(3-(5-thio-1,3,4-thiadiazol-2-yl)-3-thiapropanoic) acid;

or bis(4-(5-thio-1,3,4-thiadiazol-2-yl)-4-thiabutanoic) acid.

5. A colloidal product according to claim 1, wherein said carboxylic acid of formula (I) is combined with at least one other acid which is metaboric or orthoboric acid, a sulfur-containing carboxylic acid, a phosphoric acid or an alkyl, aryl or alkylarylphosphoric acid in a proportion of up to 90% expressed as acid equivalents with respect to the dicarboxylic acid of formula (1).

6. A colloidal product according to claim 1, wherein the overbasic, sulfonate, phenate or salicylate has a basicity reserve corresponding to a total base number up to 600 mg of potash per gram.

7. A colloidal product according to claim 1, having a sulfur content up to about 30% by weight and a nitrogen content up to about 15% by weight, relative to the weight of the colloidal product.

8. A colloidal product according to claim 1, having a calcium content up to about 30% by weight and/or a content of magnesium up to about 15% by weight, relative to the weight of the colloidal product.

9. In a lubricating oil or grease composition comprising a major proportion of lubricating oil or grease and 0.1 to 25% by weight of at least one antiwear additive, the improvement wherein the additive is a colloidal product according to claim 1.

10. In a lubricating oil or grease composition comprising a major proportion of lubricating oil or grease and 0. 1 to 25% by weight of at least one antiwear additive, the improvement wherein the additive is a colloidal product according to claim 2.

11. In a lubricating oil or grease composition comprising a major proportion of lubricating oil or grease and 0.1 to 25% by weight of at least one antiwear additive, the improvement wherein the additive is a colloidal product according to claim 3.

12. In a lubricating oil or grease composition comprising a major proportion of lubricating oil or grease and 0.1 to 25% by weight of at least one antiwear additive, the improvement wherein the additive is a colloidal product according to claim 4.

13. In a lubricating oil or grease composition comprising a major proportion of lubricating oil or grease and 0.1 to 25% by weight of at least one antiwear additive, the improvement wherein the additive is a colloidal product according to claim 5.

14. In a lubricating oil or grease composition comprising a major proportion of lubricating oil or grease and 0. 1 to 25% by weight of at least one antiwear additive, the improvement wherein the additive is a colloidal product according to claim 6.

15. In a lubricating oil or grease composition comprising a major proportion of lubricating oil or grease and 0.1 to 25% by weight of at least one antiwear additive, the improvement wherein the additive is a colloidal product according to claim 7.

16. In a lubricating oil or grease composition comprising a major proportion of lubricating oil or grease and 0.1 to 25% by weight of at least one antiwear additive, the improvement wherein the additive is a colloidal product according to claim 8.

17. An anti-wear additive comprising, in colloidal form, the reaction product of a overbasic sulfonate, phenate or salicylate having at least one calcium or magnesium carbonate dispersed within micelles therein and at least one dicarboxylic acid of formula I

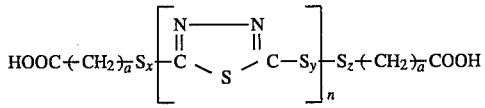

(I)

wherein a is each independently, a whole number from 1 to 8, x and z are each independently a number from 1 to 4, y is a whole number from 0 to 4 and n is 1 or 2.

* * * * *